US011009823B2

(12) United States Patent
Lee et al.

(10) Patent No.: US 11,009,823 B2
(45) Date of Patent: May 18, 2021

(54) FEED PATH SWITCHING MEMBER FOR AN IMAGE FORMING APPARATUS TO GUIDE A RECORDING MEDIUM TO A FIRST OR SECOND FEED PATH CONNECTING A FIXING UNIT AND A FEED ROLLER OF AN INKJET IMAGE FORMING UNIT

(71) Applicant: HEWLETT-PACKARD DEVELOPMENT COMPANY, L.P., Spring, TX (US)

(72) Inventors: Youngsu Lee, Pangyo (KR); Heungsup Park, Pangyo (KR); Yuntae Kim, Pangyo (KR); Eogkyu Kim, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/903,052

(22) Filed: Jun. 16, 2020

(65) Prior Publication Data

US 2020/0310323 A1 Oct. 1, 2020

Related U.S. Application Data

(63) Continuation of application No. 16/376,870, filed on Apr. 5, 2019, now Pat. No. 10,725,418, which is a (Continued)

(30) Foreign Application Priority Data

Oct. 5, 2016 (KR) ..... 10-2016-0128558

(51) Int. Cl.
*G03G 15/00* (2006.01)
*G03G 15/23* (2006.01)
(Continued)

(52) U.S. Cl.
CPC ..... *G03G 15/6573* (2013.01); *G03G 15/23* (2013.01); *G03G 15/231* (2013.01);
(Continued)

(58) Field of Classification Search
CPC .... G03G 15/23; G03G 15/231; G03G 15/234; G03G 15/235; G03G 15/238;
(Continued)

(56) References Cited

U.S. PATENT DOCUMENTS 5,289,245 A * 2/1994 Menjo ..... G03G 7/00 399/324
10,725,418 B2 * 7/2020 Lee ..... G03G 15/6579
(Continued)

FOREIGN PATENT DOCUMENTS

JP 2000-172126 6/2000
JP 2005-115132 4/2005
(Continued)

*Primary Examiner* — Joseph S Wong
(74) *Attorney, Agent, or Firm* — Staas & Halsey LLP

(57) ABSTRACT

An image forming apparatus employing an electrophotographic image forming unit and an inkjet image forming unit, thereby being capable of printing an image on each of a front surface and the back surface of a recording medium.

15 Claims, 9 Drawing Sheets

Related U.S. Application Data continuation of application No. PCT/KR2017/010400, filed on Sep. 21, 2017.

(51) Int. Cl.
*B41J 3/60* (2006.01)
*G03G 9/087* (2006.01)
*G03G 9/08* (2006.01)

(52) U.S. Cl.
CPC ..... *G03G 15/234* (2013.01); *G03G 15/235* (2013.01); *G03G 15/238* (2013.01); *G03G 15/6576* (2013.01); *G03G 15/6579* (2013.01); *B41J 3/60* (2013.01); *G03G 9/08* (2013.01); *G03G 9/08797* (2013.01)

(58) Field of Classification Search
CPC ..... G03G 15/6573; G03G 15/6576; G03G 15/6579; G03G 9/08; G03G 9/08797; B41J 3/60
See application file for complete search history.

(56) References Cited

U.S. PATENT DOCUMENTS

2006/0065145 A1* 3/2006 Martin ..... B41C 1/1066 101/450.1
2010/0209159 A1* 8/2010 Chen ..... G03G 15/231 399/364
2015/0212466 A1* 7/2015 Fukunaga ..... G03G 15/2028 399/122

FOREIGN PATENT DOCUMENTS

JP 2013-063844 4/2013
JP 2013-107363 6/2013
KR 10-0717006 5/2007

* cited by examiner

FEED PATH SWITCHING MEMBER FOR AN IMAGE FORMING APPARATUS TO GUIDE A RECORDING MEDIUM TO A FIRST OR SECOND FEED PATH CONNECTING A FIXING UNIT AND A FEED ROLLER OF AN INKJET IMAGE FORMING UNIT

CROSS-REFERENCE TO RELATED APPLICATION

This application is a continuation application of U.S. application Ser. No. 16/376,870, filed Apr. 5, 2019, which is a continuation of International Patent Application No. PCT/KR2017/010400, filed Sep. 21, 2017, which claims the benefit of Korean Patent Application No. 10-2016-0128558, filed on Oct. 5, 2016, in the Korean Intellectual Property Office, the disclosures of which are incorporated herein in their entirety by reference.

BACKGROUND

A composite image forming apparatus includes two image forming units having different image forming methods. For example, the two image forming units may be an electrophotographic image forming unit and an inkjet image forming unit.

An electrophotographic image forming unit irradiates a photoconductor with light modulated to correspond to image information to form an electrostatic latent image on a surface of the photoconductor, supplies toner to the electrostatic latent image and develops the electrostatic latent image to form a visible toner image, and transfers and fixes the toner image onto a recoding medium, thereby printing an image on the recording medium.

An inkjet image forming unit ejects ink onto paper transferred in a sub-scanning direction by using an inkjet print head, thereby printing an image. An inkjet print head includes a plurality of nozzles configured to eject ink and an ejection means configured to provide an ink ejection pressure.

A composite image forming apparatus may selectively or simultaneously drive an electrophotographic image forming unit and an inkjet image forming unit depending on the type of image, printing speed, whether a copy is double-sided, and the like, thereby printing an image on paper.

BRIEF DESCRIPTION OF DRAWINGS

FIGS. 8A and 8B illustrate examples of a fixing nip regulating member configured to form/release a fixing nip, wherein FIG. 8A illustrates a state in which the fixing nip is formed, and FIG. 8B illustrates a state in which the fixing nip is released.

DETAILED DESCRIPTION

Hereinafter, examples of a composite image forming apparatus and an image forming method according to the present disclosure will be described with reference to the accompanying drawings.

Figure 1:
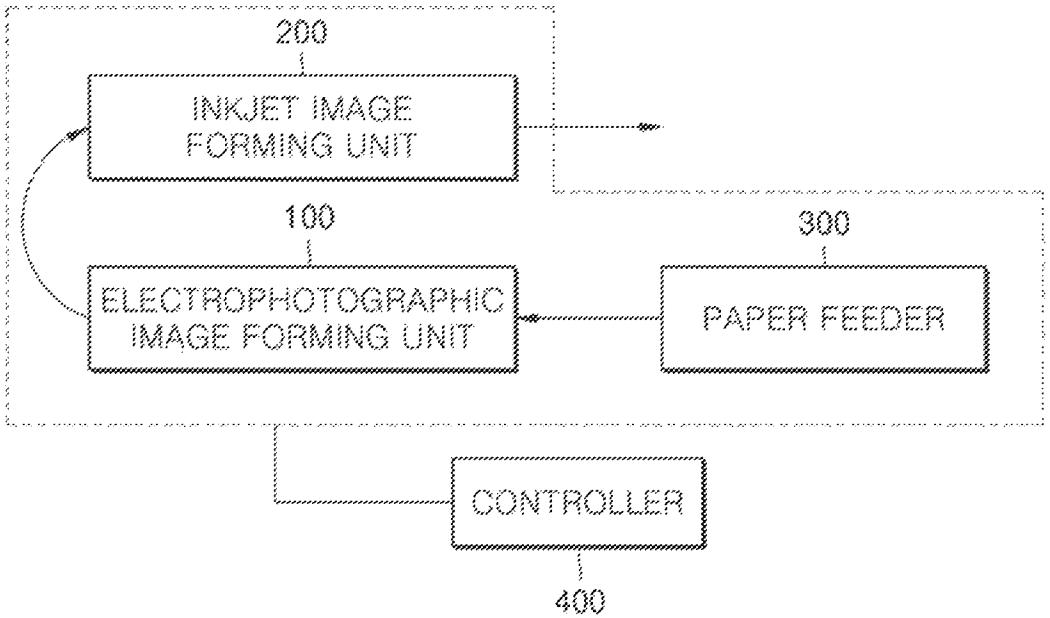
FIG. 1 is a schematic block diagram of an example of a composite image forming apparatus.

FIG. 1 is a schematic block diagram of an example of a composite image forming apparatus. Referring to FIG. 1, the composite image forming apparatus includes an electrophotographic image forming unit (a first image forming unit) 100 and an inkjet image forming unit (a second image forming unit) 200. Paper P loaded on a paper feeder 300 sequentially passes through the electrophotographic image forming unit 100 and the inkjet image forming unit 200. The electrophotographic image forming unit 100 prints an image on a surface (first surface) of a recording medium. An example of the recording medium to be used throughout is the paper P. However, the type of recording medium is not limited to the paper P. The inkjet image forming unit 200 prints an image on the back surface (second surface) of the paper P. For example, the electrophotographic image forming unit 100 may print a monochromatic image, e.g., a black-and-white image, on the surface of the paper P. The inkjet image forming unit 200 may print a color image on the back surface of the paper P. Hereinafter, the expression "may print a color image" generally may refer to the ability to also print a monochromatic image (black-and-white image).

A controller 400 may control overall operations of an image forming apparatus, including an image forming operation and include a processor such as CPU or the like. Although not shown, the image forming apparatus may further include an input/output unit, a communication unit, a memory, and a power supply unit. The input/output unit may include an input unit configured to receive, from a user, an input for performing an image forming operation, or the like, and an output unit configured to display information such as results of performing the image forming operation, a state of the image forming apparatus, and the like. For example, the input/output unit may include an operation panel configured to receive a user input, a display panel configured to display a screen, and the like. The communication unit may perform wired/wireless communication with other devices, a network, a host, or the like. To this end, the communication unit may include a communication module configured to support at least one of various wired/wireless communication methods.

The controller 400 may control components of the image forming apparatus to perform an operation that corresponds to the user input having received via the input/output unit. For example, the controller 400 may execute a program stored in the memory, read out a file stored in the memory, or store a new file in the memory. The controller 400 may selectively or simultaneously drive the electrophotographic image forming unit 100 and the inkjet image forming unit 200 on the basis of printing information input from a host (not shown).

For example, when printing information for printing a monochromatic image (black-and-white image) is input, the controller 400 may drive the electrophotographic image forming unit 100 or the inkjet image forming unit 200 to print a monochromatic image on the surface or back surface of the paper P. Generally, in the case of black-and-white images, the electrophotographic image forming unit 100 has a faster printing speed than that of the inkjet image forming unit 200, and printing costs per sheet are cheaper in the electrophotographic image forming unit 100. Thus, in the case of printing a black-and-white image, the controller 400 may drive the electrophotographic image forming unit 100.

When printing information for printing a color image is input, the controller 400 may drive the inkjet image forming unit 200 to print a color image on the back surface of the paper P. Generally, in the case of color images, it is more convenient to realize a color image by using the inkjet image forming unit 200. This is because an electrophotographic color image forming unit generally has a complex and large-sized structure as compared to an inkjet color image forming unit, and thus an image forming apparatus including an electrophotographic color image forming unit becomes larger and more expensive.

When printing information for duplex printing is input, the controller 400 may drive the electrophotographic image forming unit 100 and the inkjet image forming unit 200 to sequentially print an image on the surface and back surface of the paper P.

In the above-described example, the electrophotographic image forming unit 100 configured to print a monochromatic image is employed as a first image forming unit, and the inkjet image forming unit 200 configured to print a color image is employed as a second image forming unit, but this is not intended to limit the scope of the present disclosure. For example, the first image forming unit and the second image forming unit may be a combination of an electrophotographic image forming unit configured to print a color image and an inkjet image forming unit configured to print a color image, a combination of an electrophotographic image forming unit configured to print a color image and an inkjet image forming unit configured to print a monochromatic image, a combination of an electrophotographic image forming unit configured to print a monochromatic image and an inkjet image forming unit configured to print a monochromatic image, or the like.

The composite image forming apparatus, which is capable of performing monochromatic and color printing, small, and inexpensive, may be implemented by the electrophotographic image forming unit 100 configured to print a monochromatic image and the inkjet image forming unit 200 configured to print a color image.

Figure 2:
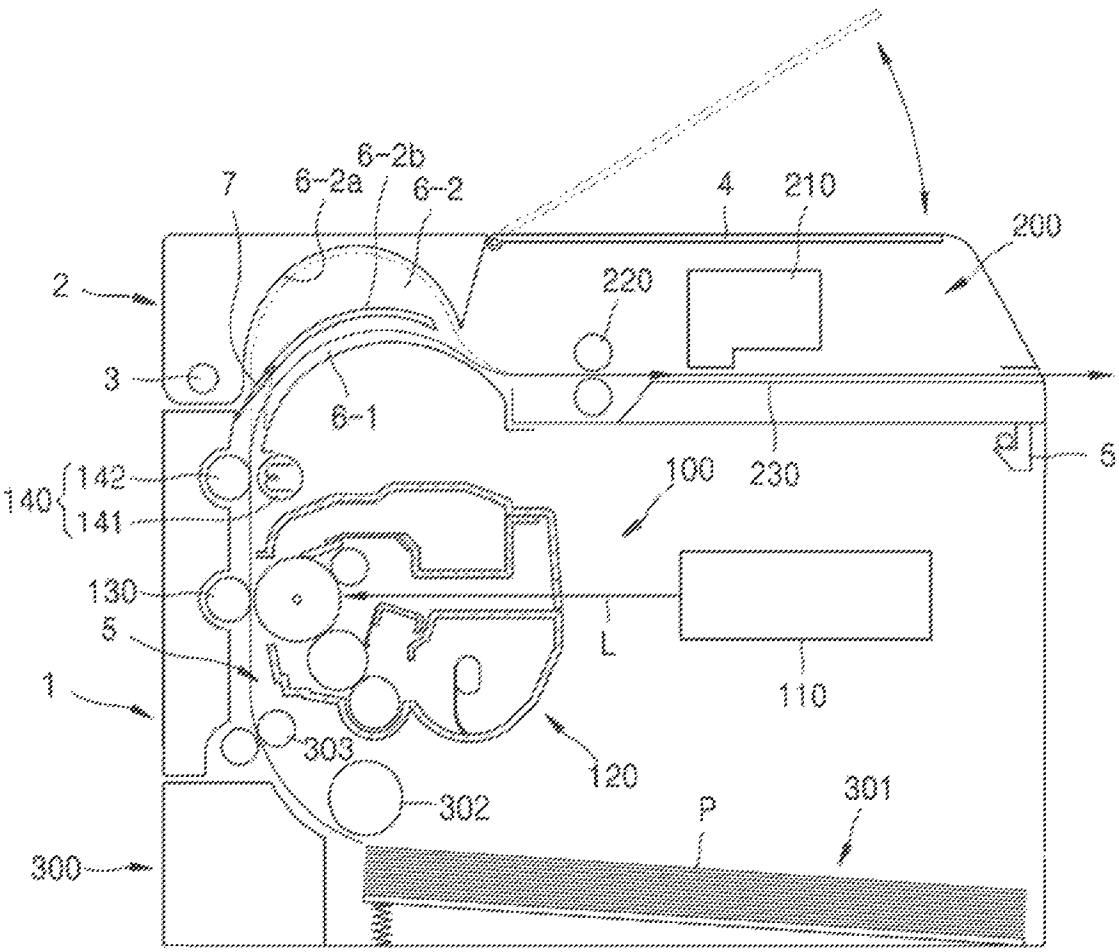
FIG. 2 is a schematic configurational view of an example of a composite image forming apparatus.

FIG. 2 is a schematic configurational view of an example of a composite image forming apparatus. Referring to FIG. 2, the image forming apparatus includes a first body 1 and a second body 2 on the first body 1. The electrophotographic image forming unit 100 is arranged in the first body 1, and the inkjet image forming unit 200 is arranged in the second body 2. The paper feeder 300 may be installed in the first body 1, for example, in the form of a cassette. To load the paper P, the paper feeder 300 may be slid outside of the first body 1 as illustrated by dotted lines in FIG. 2. The form of the paper feeder 300 is not limited to the example illustrated in FIG. 2, and the paper feeder 300 may have various forms known in the art.

Figure 3:
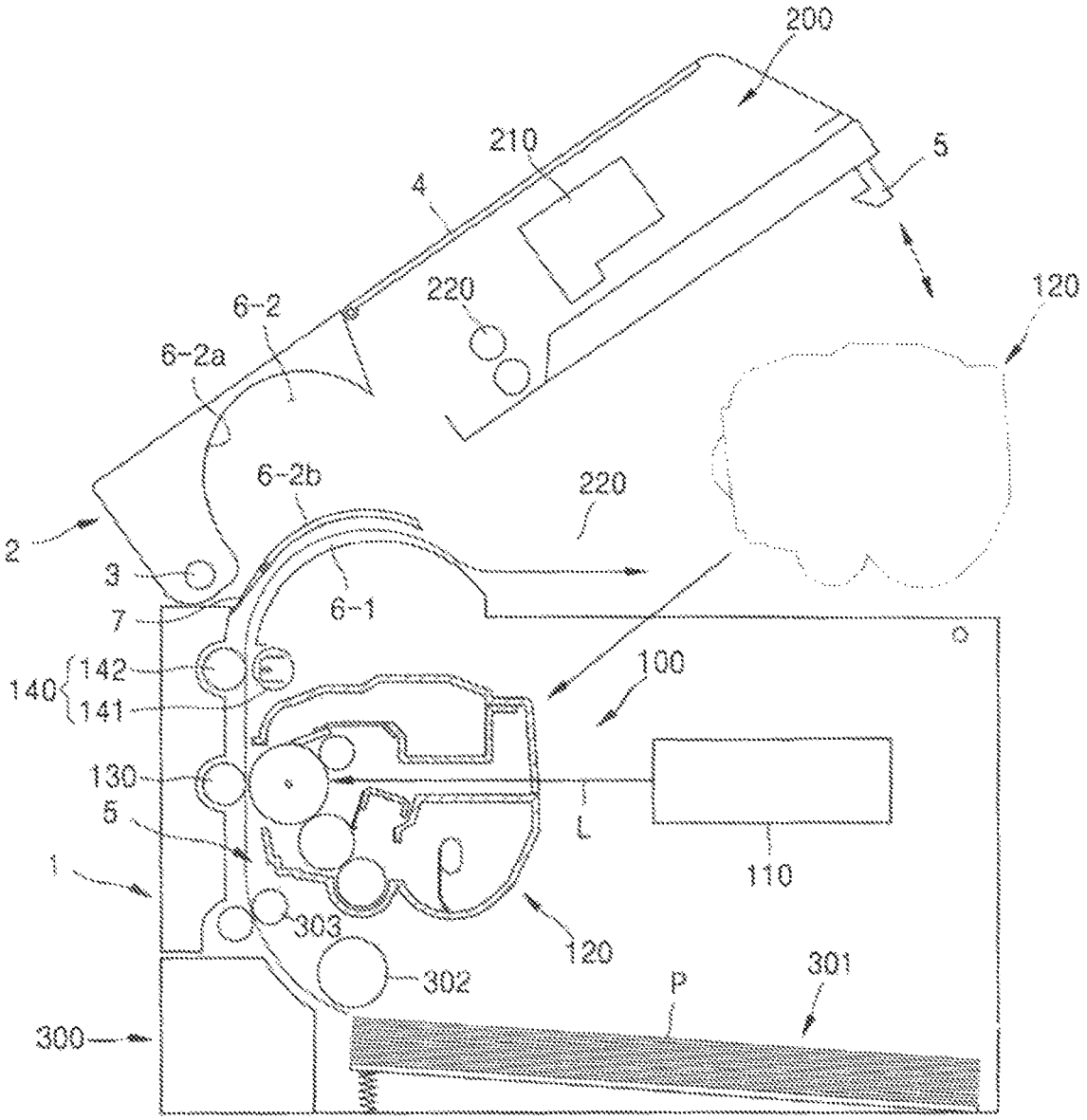
FIG. 3 is a view illustrating a state in which an upper portion of a first body is opened by a second body in the example of the composite image forming apparatus illustrated in FIG. 2.

The second body 2 may be connected to the first body 1 such that at least a portion of the first body 1 (e.g., at least a part of an upper portion of the first body 1) may be opened. FIG. 3 illustrates a state in which an upper portion of the first body 1 is opened by the second body 2 in the example of the composite image forming apparatus illustrated in FIG. 2.

Referring to FIGS. 2 and 3, the second body 2 is rotatably connected to the first body 1 via a hinge 3. Although not shown in the drawings, the hinge 3 includes a hinge shaft configured to provide a rotation center of the second body 2, and a maintenance unit configured to maintain the second body 2 in an opened state. The maintenance unit may be implemented by, for example, an elastic member configured to apply an elastic force to the second body 2 in a direction in which the second body 2 is open. The maintenance unit may also be implemented by, for example, a stopper configured to support the second body 2 with respect to the first body 1 in a state in which the second body 2 is opened. The image forming apparatus may further include a locker 5 configured to lock the second body 2 to the first body 1 when the second body 2 is in a closed state. Although not shown in the drawings, the image forming apparatus may further include a release lever configured to release the locker 5.

As illustrated in FIG. 3, when the second body 2 is rotated, the upper portion of the first body 1 is open. Through this open space, a developing device 120, which will be described below, may be installed in the first body 1 or detached from the first body 1, and paper jams that may occur during printing processes of the electrophotographic image forming unit 100 may be addressed.

Referring to FIG. 2, a cover 4 is arranged in the second body 1. The cover 4 is rotatably installed in the second body 2 to open or close at least a portion of the second body 2. For example, the cover 4 opens or closes an upper portion of the second body 2. As illustrated by broken lines in FIG. 2, when the cover 4 is open, the upper portion of the second body 2 is open. Through the open space, an inkjet print head 210, which will be described below, may be installed in the second body 2 or detached from the second body 2, and paper jams that may occur during printing processes of the inkjet image forming unit 200 may be addressed.

Figure 4:
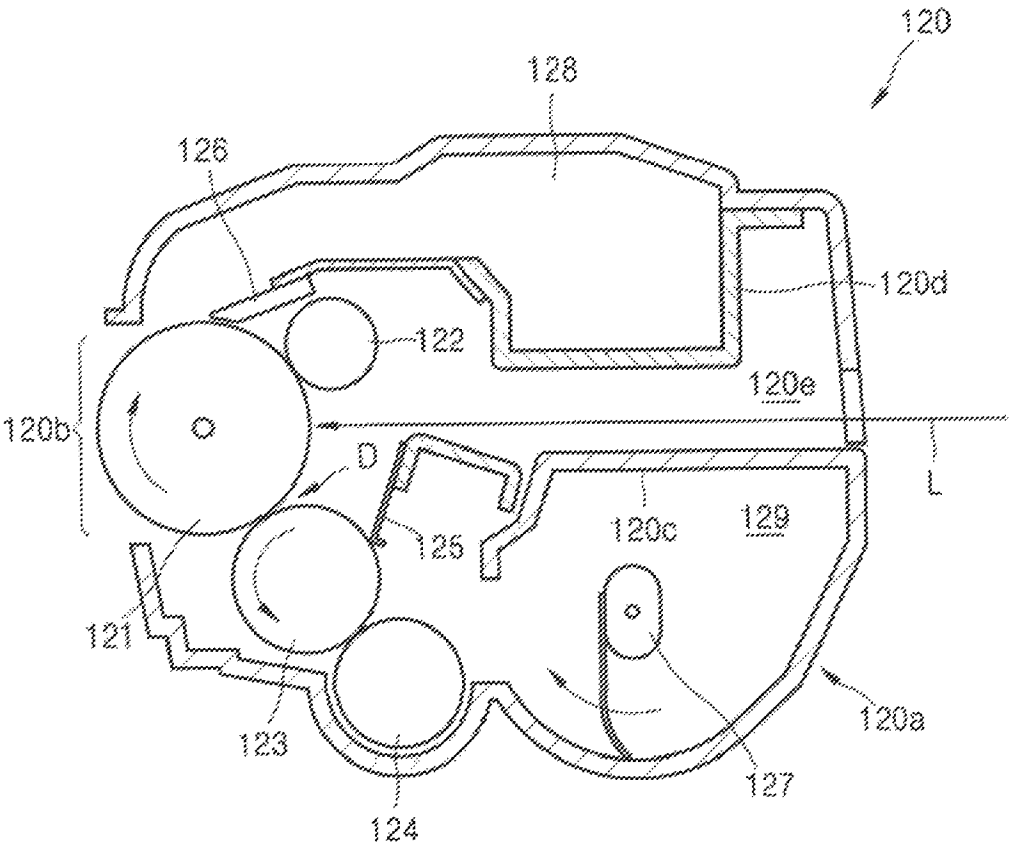
FIG. 4 is a schematic configurational view of an example of a developing device.

The electrophotographic image forming unit 100 of the present example prints a monochromatic image (black-and-white image). The electrophotographic image forming unit 100 may include an exposure unit 110, a developing device 120, a transfer unit, and a fixing unit 140. FIG. 4 is a schematic configurational view of an example of the developing device 120. The developing device 120 of FIG. 4 may employ various known developing structures such as a two-component developing structure, a one-component non-contact developing structure, a one-component contact developing structure, and the like. In one example, the developing device 120 of the present example employs a one-component non-contact developing structure.

Referring to FIGS. 2 and 4, a photoconductive drum 121 is an example of a photoconductor on which an electrostatic latent image is formed, and may include a photoconductive layer having photoconductivity formed on an outer circumferential surface of a cylindrical metal pipe. A charging roller 122 is an example of a charger configured to charge a surface of the photoconductive drum 121 with uniform electric potential. A charging bias voltage is applied to the charging roller 122. A corona charger (not shown) may also be used instead of the charging roller 122. A developing roller 123 is configured to supply toner to an electrostatic latent image formed on a surface of the photoconductive drum 121 to develop the electrostatic latent image. In the present example, a surface of the developing roller 123 is spaced apart from the surface of the photoconductive drum 121 by an interval of about tens to about hundreds of microns. The interval is referred to as a developing gap D. When a developing bias voltage is applied to the developing roller 123, toner is transferred onto the electrostatic latent image formed on the surface of the photoconductive drum 121 via the developing gap D and attached thereto.

A supply roller 124 may further be arranged in the developing device 120 to attach toner to the developing roller 123. A supply bias voltage may be applied to the supply roller 124 to attach toner to the developing roller 123. A regulating member 125 is configured to regulate the amount of toner attached to the surface of the developing roller 123. The regulating member 125 may be, for example, a regulating blade, a tip of which comes into contact with the developing roller 123 by a predetermined pressure. A cleaning member 126 is configured to remove residual toner and impurities from the surface of the photoconductive drum 121 before charging. The cleaning member 126 may be, for example, a cleaning blade, a tip of which comes into contact with the surface of the photoconductive drum 121. Waste toner having been removed from the surface of the photoconductive drum 121 may be accommodated in a waste toner container 128.

Toner is accommodated in a toner container 129. An agitator 127 is installed in the toner container 129. The agitator 127 serves to transfer toner to the developing roller 123. The agitator 127 may also serve to charge toner with a predetermined electric potential by agitating the toner. Although a single agitator 127 is illustrated in FIG. 3, this is not intended to limit the scope of the present disclosure. To effectively supply toner to the developing roller 123 in consideration of the volume or type of the toner container 129, an appropriate number of agitators 127 may be installed in the toner container 129 at appropriate positions. The agitator 127 may be in a form in which at least one flexible film-type agitating blade is arranged at a rotation shaft. Although not shown in the drawings, the agitator 127 may also be an auger including a spiral-type agitating blade. The agitator 127 transfers toner to the developing roller 123 and triboelectrically charges the toner by agitating the toner.

A housing 120*a* forms the toner container 129 and the waste toner container 128 and acts as a frame that supports components constituting the developing device 120, such as a photoconductor 121, the charging roller 122, the developing roller 123, the supply roller 124, the agitator 127, and the like. An outer circumference of the photoconductive drum 121 is partially exposed outside of the housing 120*a* via an opening 120*b*. First and second barrier ribs 120*c* and 120*d* may be arranged inside the housing 120*a*. The first barrier rib 120*c* and the second barrier rib 120*d* are spaced apart from each other such that the photoconductive drum 121 is exposed therebetween, thereby forming an optical path 120*e* through which light L emitted from the exposure unit 110 (see FIG. 2) is incident.

The exposure unit 110 scans light modulated in accordance with image information onto the surface of the photoconductive drum 121 charged with uniform electric potential. The exposure unit 110 may be, for example, a laser scanning unit (LSU) configured to deflect light emitted from a laser diode in a main scanning direction by using a polygon mirror and scan the light onto the photoconductive drum 121.

A transfer roller 130 is an example of a transfer unit placed opposite to the surface of the photoconductive drum 121 and configured to form a transfer nip. A transfer bias voltage is applied to the transfer roller 130 so as to transfer a toner image developed on the surface of the photosensitive drum 121 to the paper P. Instead of the transfer roller 130, a corona transfer unit may also be used.

The toner image, which has been transferred to a surface of the paper P by the transfer roller 130, is maintained on the surface of the paper P by electrostatic attraction. The fixing unit 140 fixes the toner image onto the paper P by applying heat and pressure thereto, thus forming a permanent printed image on the paper P. The fixing unit 140 forms a fixing nip through the paper P passes. For example, the fixing unit 140 may include a heating roller (heating member) 141 and a pressing roller (pressurization portion) 142 that form a fixing nip and rotate while being engaged with each other. The heating roller 141 is heated by a heater 143. The heating roller 141 faces the surface of the paper P. The form of the fixing unit 140 is not limited to that illustrated in FIG. 2, and a belt (not shown) may also be employed instead of the heating roller 141.

An image forming process will now be briefly described using the above-described configurations.

A charging bias voltage is applied to the charging roller 122, and the photoconductive drum 121 is charged with uniform electric potential. The exposure unit 110 scans light modulated in accordance with image information onto the photoconductive drum 121 via the optical path 120*e* arranged in the developing device 120, thereby forming an electrostatic latent image on the surface of the photoconductive drum 121. Toner is transported by the agitator 127 towards the supply roller 124, and the supply roller 124 attaches the toner to the surface of the developing roller 123. A regulating member 125 forms a toner layer having a uniform thickness on the surface of the developing roller 123. A developing bias voltage is applied to the developing roller 123. As the developing roller 123 is rotated, toner transported to a developing nip D is transferred and attached to an electrostatic latent image formed on a surface of the photoconductive drum 121 by the developing bias voltage, thereby forming a visible toner image on the surface of the photoconductive drum 121. The paper P taken out of a loading tray 301 by a pickup roller 302 is transferred by a feed roller 303 to a transfer nip formed such that the transfer roller 130 and the photoconductive drum 121 face each other. When a transfer bias voltage is applied to the transfer roller 130, the toner image is transferred onto the paper P by electrostatic attraction. The toner image transferred onto the paper P is fixed on the paper P by receiving heat and pressure from the fixing unit 140, thereby completing electrophotographic printing. The paper P passes through the inkjet image forming unit 200 and is discharged outside. Toner that has not been transferred to the paper P and has remained on the surface of the photoconductive drum 121 is removed by the cleaning member 126 and accommodated in the waste toner container 128.

Figure 5:
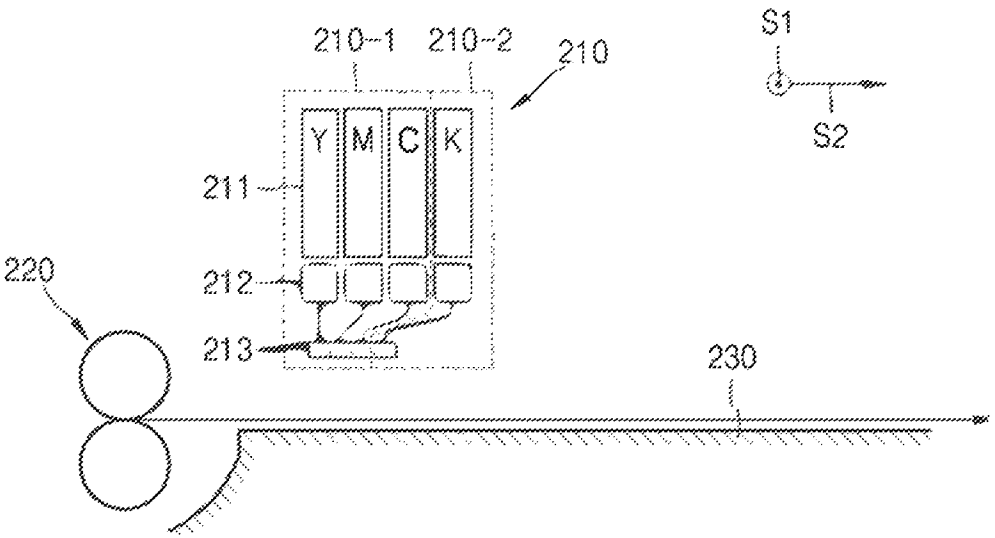
FIG. 5 is a schematic configurational view of an example of an inkjet image forming unit.

The inkjet image forming unit 200 of the present example prints a color image. FIG. 5 is a schematic configurational view of an example of the inkjet image forming unit 200. Referring to FIGS. 2 and 5, the inkjet image forming unit 200 includes the inkjet print head 210, and a feed roller 220 configured to transport the paper P having passed through the electrophotographic image forming unit 100 to below the inkjet print head 210. The paper P is transported by the feed roller 220 in a sub-scanning direction S2. A platen 230 may be arranged at a position facing the inkjet print head 210. The platen 230 evenly supports the paper P. The inkjet print head 210 ejects ink onto the paper P supported by the platen 230 and transported by the feed roller 220 to print an image.

The inkjet print head 210 includes four ink tanks 211Y, 211M, 211C, and 211K configured to respectively accommodate ink of yellow (Y) color, ink of magenta (M) color, ink of cyan (C) color, and ink of black (K) color, and head chips 213Y, 213M, 213C, and 213K. The head chips 213Y, 213M, 213C, and 213K are respectively connected to the ink tanks 211Y, 211M, 211C, and 211K via supply lines 212Y, 212M, 212C, and 212K, respectively. Each of the head chips 213Y, 213M, 213C, and 213K includes a chamber (not shown), an ejection means (not shown), and nozzles (not shown). Ink accommodated in an ink tank 211 is supplied to the chamber via a supply line 213. The nozzles are connected to the chamber. The ejection means ejects ink via the nozzles by applying pressure to the ink inside the chamber. The ejection means forms an ejection pressure in the chamber by a piezoelectric method, a heating method, or the like. For example, a piezoelectric-type ejection means partially deforms a wall constituting a chamber by applying a driving voltage to a piezoelectric element to change a volume of the chamber, thereby forming an ejection pressure. When a driving signal applied to the piezoelectric element is turned on, ink is ejected via nozzles, and when the driving signal is turned off, new ink is introduced into the chamber from the ink tank 211 while the volume of the chamber is restored to its original volume. A heating-type ejection means expands air bubbles inside ink by heating ink inside a chamber using a heating element, thereby forming an ejection pressure. When a driving signal applied to the heating element is turned off, air bubbles contract and new ink is introduced into the chamber from the ink tank 211. A detailed description of the ejection means will not be provided herein.

Figure 6:
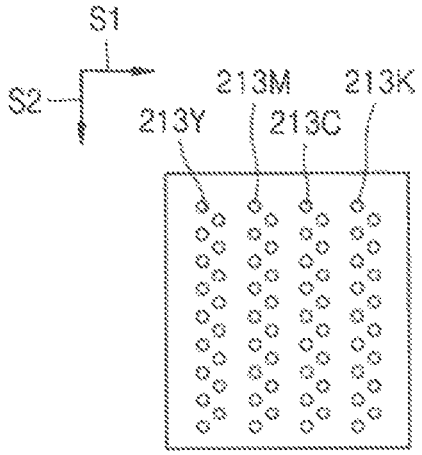
FIGS. 6 and 7 respectively illustrate examples of the shape of nozzles of a shuttle-type inkjet print head.
Figure 7:
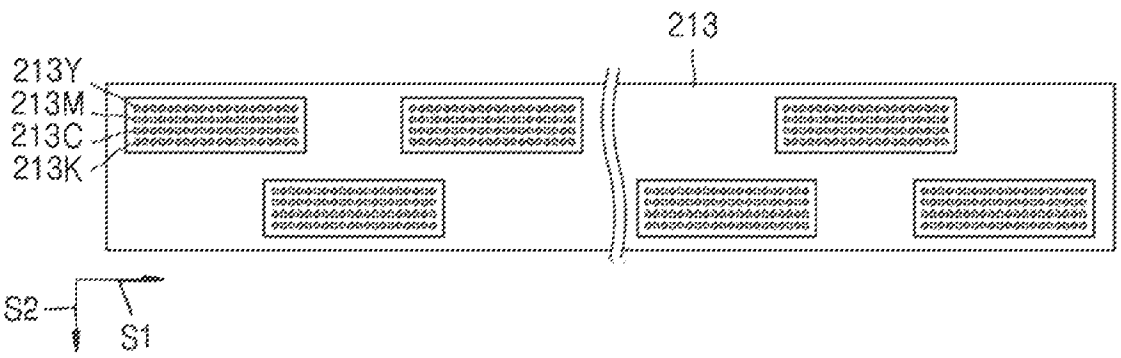

The inkjet print head 210 may be a shuttle-type inkjet head that reciprocates in a main scanning direction S1, or may also be an array inkjet print head having a length in the main scanning direction S1, corresponding to the width of the paper P and ejecting ink over an overall width of the paper P. FIGS. 6 and 7 each illustrates an example of the shape of nozzles of a shuttle-type inkjet print head. In FIGS. 6 and 7, 213Y, 213M, 213C, and 213K denote nozzles configured to eject ink of yellow color, ink of magenta color, ink of cyan color, and ink of black color, respectively. Arrangement of the nozzles 213Y, 213M, 213C, and 213K is not limited to that illustrated in FIGS. 6 and 7.

The inkjet print head 210 of the present example is a shuttle-type inkjet print head. Although not shown in the drawings, the inkjet image forming unit 200 may further include a cap mechanism configured to cover nozzles to prevent drying of the nozzles, a pumping mechanism configured to clean the clogged nozzles, and the like. The ink tanks 211Y, 211M, 211C, and 211K may be individually replaced. The inkjet print head 210 may also be replaced with a single unit. In addition, a first portion 210-1 configured to eject ink of yellow color, cyan color, and magenta color and a second portion 210-2 configured to eject ink of black color may also be individually replaced.

An inkjet image forming process will be briefly described using the above-described configurations. The paper P taken out of the paper feeder 300 and passing through the electrophotographic image forming unit 100 is transported by the feed roller 220 in the sub-scanning direction S2. The paper P is maintained by the platen 230 at a predetermined interval, e.g., about 0.5 mm to about 2 mm, from a head chip 213 of the inkjet print head 210. The inkjet print head 210 ejects ink while reciprocating in the main scanning direction S1 to thereby print an image on the paper P. The paper P on which printing has been completed is discharged outside.

A paper feed path 6 is formed such that a surface of the paper P faces against the photoconductive drum 121 of the electrophotographic image forming unit 100 and the back surface of the paper P faces against the head chip 213 of the inkjet image forming unit 200. In the present example, the paper feeder 300 is located below the electrophotographic image forming unit 100, and the inkjet image forming unit 200 is located above the electrophotographic image forming unit 100, such that the paper feed path 6 connecting the paper feeder 300, the electrophotographic image forming unit 100, and the inkjet image forming unit 200 is "C"-shaped overall.

Paper detection sensors (not shown) configured to detect the paper P are arranged along the paper feed path 6. For example, first and second paper detection sensors may be respectively arranged around the feed roller 303 and around the feed roller 220. For example, the controller 400 may detect whether the paper P is taken out of the paper feeder 300, from a detection signal of the first paper detection sensor arranged around the feed roller 303, and may detect a front end position of the paper P as a reference for initiating electrophotographic printing. The controller 400 may determine that the paper P has passed through a transfer nip and a fixing nip when a predetermined time elapses after the paper P is detected by the first paper detection sensor. In addition, the controller 400 may detect a front end position of the paper P as a reference for initiating inkjet printing, from a detection signal of the second paper detection sensor arranged around the feed roller 220.

When electrophotographic printing is performed, the electrophotographic image forming unit 100 is driven. In the inkjet image forming unit 200, while the feed roller 220 is driven, the inkjet print head 210 is not driven. The controller 400 controls the feed roller 220 to be driven to discharge, to the outside, the paper P on which an image is printed by the electrophotographic image forming unit 100.

When inkjet printing is performed, the inkjet image forming unit 200 is driven. The electrophotographic image forming unit 100 is driven to transport the paper P. That is, the photoconductive drum 121, the transfer roller 130, and the fixing unit 140 are operated to transport the paper P.

The electrophotographic image forming unit 100 generally transports the paper P at a constant speed. However, the inkjet image forming unit 200 intermittently transports the paper P in accordance with the amount or type of printing data. Thus, the electrophotographic image forming unit 100 has a paper-feeding speed that is at least the same or faster than that of the inkjet image forming unit 200. When the electrophotographic image forming unit 100 has a slower paper-feeding speed than that of the inkjet image forming unit 200, intermittent printing by the inkjet image forming unit 200 may be impossible and paper jams may occur. Thus, the controller 400 controls the electrophotographic image forming unit 100 and the inkjet image forming unit 200 to operate such that the paper-feeding speed of the electrophotographic image forming unit 100 is the same as or slightly faster than that of the inkjet image forming unit 200.

When duplex printing is performed, the electrophotographic image forming unit 100 and the inkjet image forming unit 200 are sequentially operated. Ideally, printing has to start in the inkjet image forming unit 200 after the paper P completely passes through the electrophotographic image forming unit 100. In this case, however, the fixing unit 140 and the feed roller 220 have to be separated from each other by a length in the sub-scanning direction S2 of the paper P, and this causes an increase in the size of the image forming apparatus.

Referring to FIG. 2, the image forming apparatus of the present example includes first and second feed paths 6-1 and 6-2 connecting the fixing unit 140 and the feed roller 220. The second feed path 6-2 is longer than the first feed path 6-1. The second feed path 6-2 has a structure capable of accommodating a curl of the paper P. Curling prevents the paper P from being confined between the fixing unit 140 and the feed roller 220 in a state in which tension acts on the paper P. For example, a lower guide 6-2*b* and an upper guide 6-2*a* of the second feed path 6-2 are sufficiently spaced apart from each other to form a space accommodating a curl. The second feed path 6-2 is formed such that at least 60% of a full length of the paper P can be accommodated by being curled between the fixing unit 140 and the feed roller 220.

For example, the second feed path 6-2 may be formed such that about 60% to about 70% of the full length of the paper P can be accommodated. Accordingly, an increase in the size of the image forming apparatus may be suppressed and stable duplex printing is possible.

The image forming apparatus includes a feed path switching member 7. The feed path switching member 7 switches to a first position (a position illustrated by a solid line in FIG. 2) that guides the paper P having passed through the fixing unit 140 to the first feed path 6-1 and to a second position (a position illustrated by dotted lines in FIG. 2) that guides the paper P having passed through the fixing unit 140 to the second feed path 6-2. For example, the feed path switching member 7 may be pivoted to the first and second positions. Although not shown in the drawings, the feed path switching member 7 may switch to the first and second positions by an actuator such as a solenoid or the like.

When individual printing is performed, i.e., when any one of the electrophotographic image forming unit 100 and the inkjet image forming unit 200 is operated, the controller 400 switches the feed path switching member 7 to the first position.

When duplex printing is performed by simultaneously operating the electrophotographic image forming unit 100 and the inkjet image forming unit 200, the controller 400 switches the feed path switching member 7 to the second position. When a front end of the paper P, on which an image is printed by the electrophotographic image forming unit 100, passes through the fixing unit 140, the paper P is guided to the feed path switching member 7 and transported to the second feed path 6-2. The front end of the paper P comes into contact with the upper guide 6-2*a* by rigidity thereof, and is guided to the feed roller 220 by the upper guide 6-2*a*. The surface of the paper P is separated from the lower guide 6-2*b* by rigidity thereof. Accordingly, curling of the paper P occurs between the fixing unit 140 and the feed roller 220 and is accommodated in the second feed path 6-2. By such configurations, even though the paper-feeding speed of the inkjet image forming unit 200 is partially faster than that of the electrophotographic image forming unit 100, excessive tension does not occur on the paper P before the paper P comes into contact with the lower guide 6-2*b* in the second feed path 6-2, and a difference in the paper-feeding speed between the electrophotographic image forming unit 100 and the inkjet image forming unit 200 may be compensated for by the curling. Thus, when the paper P is stuck simultaneously in the electrophotographic image forming unit 100 and the inkjet image forming unit 200, paper feeding defects due to the difference in paper-feeding speed between the electrophotographic image forming unit 100 and the inkjet image forming unit 200 and consequent printing defects may be prevented, and stable duplex printing is possible.

When the inkjet image forming unit 200 is operated and the electrophotographic image forming unit 100 is not operated, the fixing unit 140 may not need to transport the paper P. Thus, in this case, the fixing nip of the fixing unit 140 may be released. In addition, as described above, the transfer roller 130 forms a transfer nip while facing the photoconductive drum 121, and when the inkjet image forming unit 200 is operated and the electrophotographic image forming unit 100 is not operated, the transfer nip may be released. Then, the paper P is supplied by the feed roller 303 to the feed roller 220 via the first feed path 6-1, and is transported by the feed roller 220 at a predetermined printing speed.

When duplex printing is performed, the controller 400 may release the transfer nip after an end of the paper P passes through the transfer nip and may release the fixing nip after the end of the paper P passes through the fixing nip.

As such, when the inkjet image forming unit 200 is operated, or duplex printing is performed, the transfer nip (fixing nip) may be released after the end of the paper P passes through the transfer nip (fixing nip), and thus the paper P may be more stably transported and printing may be more stably performed by the inkjet image forming unit 200.

Figure 8A:
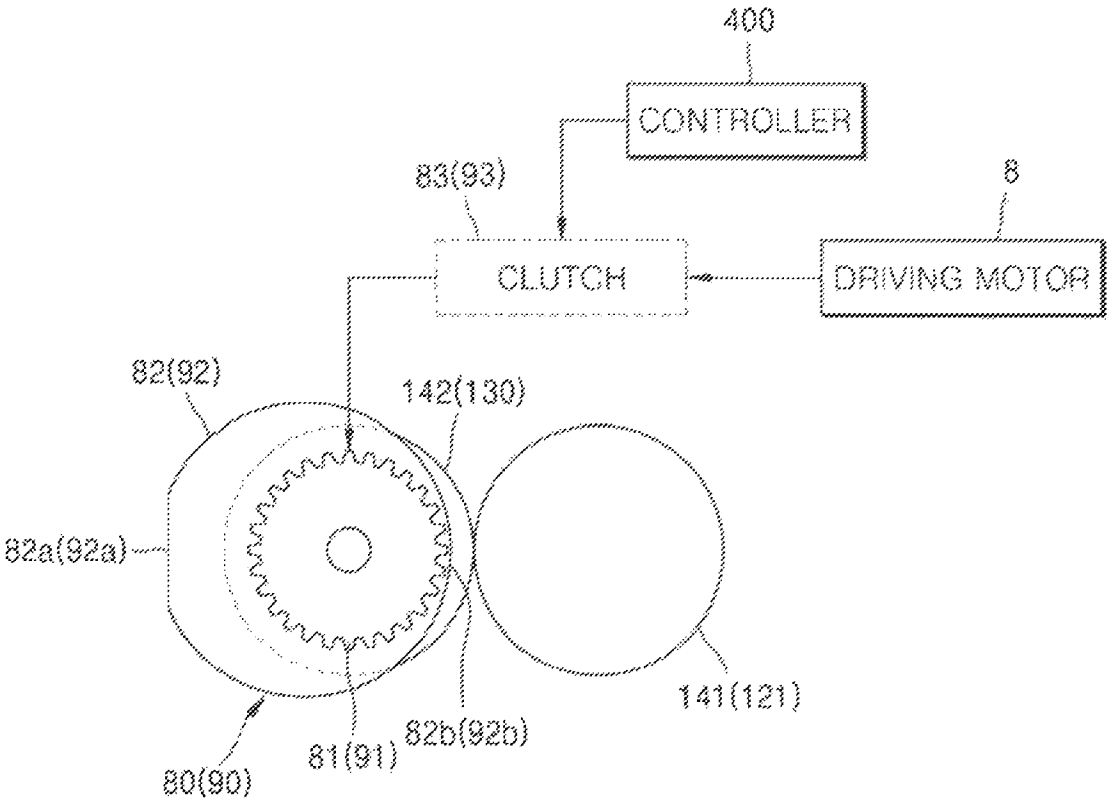
Figure 8B:
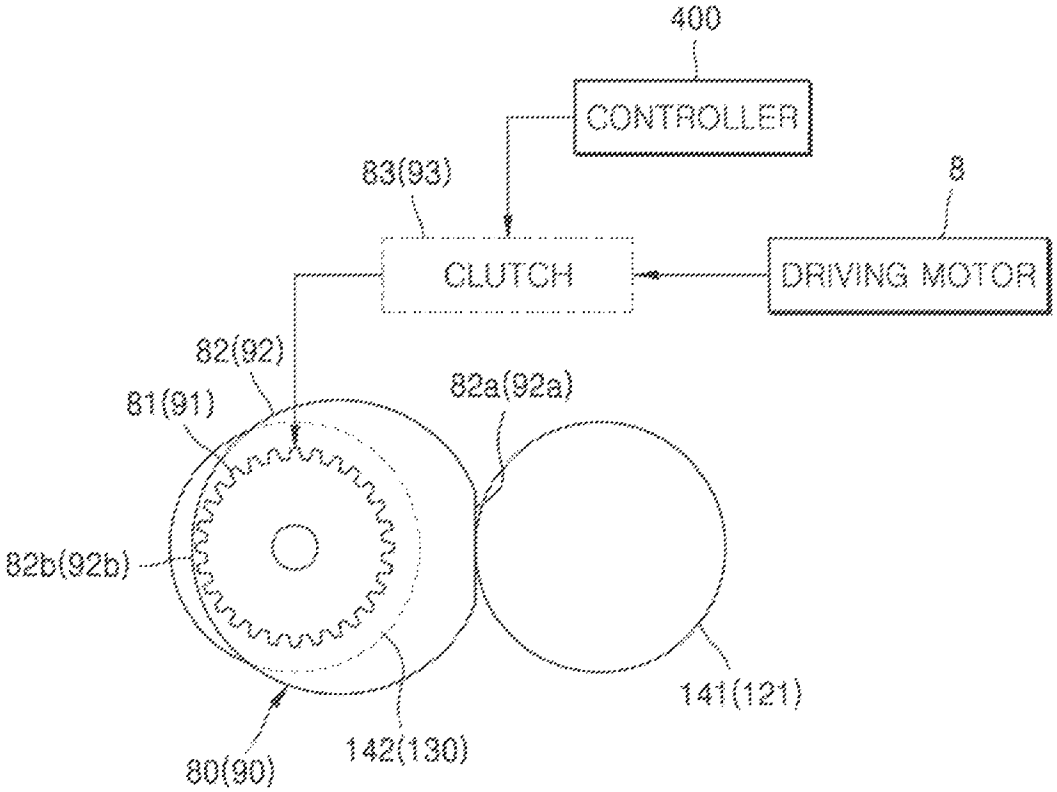

Each of FIGS. 8A and 8B illustrates an example of a fixing nip regulating member 80 configured to form/release a fixing nip, wherein FIG. 8A illustrates a state in which the fixing nip is formed, and FIG. 8B illustrates a state in which the fixing nip is released.

Referring to FIGS. 8A and 8B, the fixing nip regulating member 80 forms/releases the fixing nip by, for example, bringing/separating the pressing roller 142 into contact with/from the heating roller 141. For example, the fixing nip regulating member 80 is rotatably installed on a rotation shaft of the pressing roller 142. The fixing nip regulating member 80 includes a gear portion 81 rotated by a driving motor 8, and a cam 82. The cam 82 includes first and second cam portions 82*a* and 82*b* facing the heating roller 141 in accordance with a rotation phase of the fixing nip regulating member 80. The first cam portion 82*a* has a larger radius than that of the pressing roller 142, and the second cam portion 82*b* has a smaller radius than that of the pressing roller 142.

The pressing roller 142 is elastically biased by an elastic member (not shown) in a direction in which the pressing roller 142 comes into contact with the heating roller 141. As illustrated in FIG. 8A, when the second cam portion 82*b* faces the heating roller 141, the pressing roller 142 comes into contact with the heating roller 141 by an elastic force of the elastic member, and a fixing nip is formed. When the first cam portion 82*a* faces the heating roller 141, the first cam portion 82*a* comes into contact with the heating roller 141. Then, the pressing roller 142 is pushed in a direction opposite to the direction of the elastic force, and as illustrated in FIG. 8B, the pressing roller 142 is separated from the heating roller 141, and thus the fixing nip is released.

A clutch 83 may be arranged between the driving motor (actuator) 8 and the gear portion 81. The driving motor 8 may drive the electrophotographic image forming unit 100. The clutch 83 selectively connects the driving motor 8 and the gear portion 81. The controller 400 may control the clutch 83 to be turned on/off to rotate the fixing nip regulating member 80, thereby forming/releasing the fixing nip. When the inkjet image forming unit 200 is operated, the controller 400 may release the fixing nip by driving the fixing nip regulating member 80. In addition, when the electrophotographic image forming unit 100 and the inkjet image forming unit 200 are simultaneously operated, the controller 400 may form a fixing nip by driving the fixing nip regulating member 80, print an image on the surface of the paper P by driving the electrophotographic image forming unit 100, and release the fixing nip by driving the fixing nip regulating member 80 after the end of the paper P passes through the fixing nip.

A structure of a transfer nip regulating member 90 configured to form/release a transfer nip may be similar to that of the fixing nip regulating member 80. For example, an example of the transfer nip regulating member 90 will be described using reference numerals described in parentheses of FIGS. 8A and 8B. Referring to FIGS. 8A and 8B, the transfer nip regulating member 90 forms/releases a transfer nip by, for example, bringing/separating the transfer roller 130 into contact with/from the photoconductive drum 121.

The transfer nip regulating member 90 may be, for example, rotatably installed on a rotation shaft of the transfer roller 130. The transfer nip regulating member 90 includes a gear portion 91 rotated by the driving motor 8, and a cam 92. The cam 92 includes first and second cam portions 92*a* and 92*b* facing the heating roller 141 in accordance with a rotation phase of the transfer nip regulating member 90. The first cam portion 92*a* has a larger radius than that of the transfer roller 130, and the second cam portion 92*b* has a smaller radius than that of the transfer roller 130.

The transfer roller 130 is elastically biased by an elastic member (not shown) in a direction in which the transfer roller 130 comes into contact with the photoconductive drum 121. As illustrated in FIG. 8A, when the second cam portion 92*b* faces the photoconductive drum 121, the transfer roller 130 comes into contact with the photoconductive drum 121 by an elastic force of the elastic member, and a transfer nip is formed. When the first cam portion 92*a* faces the photoconductive drum 121, the first cam portion 92*a* comes into contact with the photoconductive drum 121. Then, the transfer roller 130 is pushed in a direction opposite to the direction of the elastic force, and as illustrated in FIG. 8B, the transfer roller 130 is separated from the photoconductive drum 121, and thus the transfer nip is released.

The controller 400 may control a clutch 93, which is configured to selectively connect the driving motor (actuator) 8 and the gear portion 91, to be turned on/off to rotate the transfer nip regulating member 90, thereby forming/releasing the transfer nip. When the inkjet image forming unit 200 is operated, the controller 400 may release the fixing nip by driving the transfer nip regulating member 90. In addition, when the electrophotographic image forming unit 100 and the inkjet image forming unit 200 are simultaneously operated, the controller 400 may form a transfer nip by driving the transfer nip regulating member 90, print an image on the surface of the paper P by driving the electrophotographic image forming unit 100, and release the transfer nip by driving the transfer nip regulating member 90 after the end of the paper P passes through the transfer nip.

The structures of the fixing nip regulating member 80 and the transfer nip regulating member 90 are not limited to the examples illustrated in FIGS. 8A and 8B. The driving motor 8 may be a motor configured to transfer the paper P, or may also be an exclusive actuator configured to drive the fixing nip regulating member 80 and the transfer nip regulating member 90. In this case, the controller 400 may selectively drive the fixing nip regulating member 80 and the transfer nip regulating member 90 by selectively turning on/off the clutch 83 or 93. In addition, when two driving motors 8 configured to respectively drive the fixing nip regulating member 80 and the transfer nip regulating member 90 are arranged, the clutch 83 or 93 is omitted, and the controller 400 may selectively drive the fixing nip regulating member 80 and the transfer nip regulating member 90 by selectively turning on/off the two driving motors 8.

In another example of the composite image forming apparatus according to the present disclosure, toner used in an electrophotographic image forming unit may include, for example, a colorant, a binder resin, and a releasing agent.

The toner may include various colorants. When the electrophotographic image forming unit prints a monochromatic image, the toner may include black toner. When the electrophotographic image forming unit prints a color image, the toner may include yellow toner, magenta toner, and cyan toner. When the electrophotographic image forming unit prints a monochromatic image and a color image, the toner may include black toner, yellow toner, magenta toner, and cyan toner. The black toner includes a black colorant. Non-limiting examples of the black colorant may include carbon black, aniline black, and a combination thereof. The yellow toner includes a yellow colorant. Non-limiting examples of the yellow colorant may include a condensed nitrogen compound, an isoindolinone compound, an anthraquinone compound, an azo metal complex, an allyl imide compound, and a combination thereof. For example, the yellow toner may include C.I. Pigment Yellow 12, 13, 14, 17, 62, 74, 83, 93, 94, 95, 109, 110, 111, 128, 129, 147, 168, and 180, and a combination thereof. Magenta toner includes a magenta colorant. Non-limiting examples of the magenta colorant may include a condensed nitrogen compound, an anthraquinone compound, a quinacridone compound, a base dye lake compound, a naphthol compound, a benzoimidazole compound, a thioindigo compound, a perylene compound, and a combination thereof. For example, the magenta toner may include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254, and a combination thereof, Cyan toner includes a cyan colorant, Non-limiting examples of the cyan colorant may include a copper phthalocyanine compound or a derivative thereof, an anthraquinone compound, a base dye lake compound, and a mixture thereof. For example, the cyan colorant may include C.I. Pigment Blue 1, 7, 15, 15:1, 15:2, 15:3, 15:4, 60, 62, and 66, and a combination thereof. When the amount of the colorant in the toner is too small, the toner may not exhibit a desired color. When the amount of the colorant in the toner is too large, the toner may not exhibit a sufficient friction charging amount. In addition, when the amount of the colorant in the toner is too large, toner preparation costs may be increased. For example, the amount of the colorant in the toner may range from about 0.1 parts by weight to about 20 parts by weight with respect to 100 parts by weight of the binder resin.

The toner may include various binder resins. Non-limiting examples of the binder resin may include polystyrene, poly-p-chlorostyrene, poly-α-methylstyrene, styrene-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-indene copolymer, styrene-maleic acid copolymer, styrene-maleic ester copolymer, polymethyl methacrylate, polyethyl methacrylate, polybutyl methacrylate, copolymers of at least two selected from methyl methacrylate, ethyl methacrylate and butyl methacrylate; polyvinyl chloride, polyvinyl acetate, polyethylene, polypropylene, a polyester, a polyurethane, a polyamide, an epoxy resin, polyvinyl butyral resin, rosin, a modified rosin, a terpene resin, a phenolic resin, an aliphatic or alicyclic hydrocarbon resin, an aromatic petroleum resin, a chlorinated paraffin, paraffin wax, and a combination thereof.

Non-limiting examples of the releasing agent may include a polyethylene-based wax, a polypropylene-based wax, a silicone wax, a paraffin-based wax, an ester-based wax, a carnauba-based wax, a metallocene wax, and a combination thereof. The releasing agent may have a melting point in a range of, for example, about 50° C. to about 150° C. The amount of the releasing agent in the toner may be, for example, in a range of about 1 part by weight to about 20 parts by weight with respect to 100 parts by weight of the binder resin, but the present disclosure is not limited thereto.

The toner may further include a charge control agent. Non-limiting examples of the charge control agent may include a salicylic acid compound containing a metal such as zinc or aluminum, a boron complex of bis diphenyl glycolic acid, a silicate, and a combination thereof. For example, the charge control agent may include zinc dialkyl salicylate, baro bis(1,1-diphenyl-1-oxo-acetyl potassium salt), and a combination thereof. The amount of the charge control agent in the toner may be, for example, in a range of about 0.5 parts by weight to about 1.5 parts by weight with respect to 100 parts by weight of the binder resin.

The toner may further include a shell layer. The shell layer covers core particles including a colorant, a binder resin, and a releasing agent. The shell layer includes a binder resin for a shell. The binder resin for a shell may be, for example, but is not limited to, a styrenic resin, an acrylic resin, a vinyl resin, a polyether polyol resin, a phenolic resin, a silicone resin, a polyester resin, an epoxy resin, a polyimide resin, a polyurethane resin, polybutadiene resin, or a mixture thereof. The styrenic resin may be, for example, but is not limited to, polystyrene; a homopolymer of a styrene with a substituent such as poly-p-chlorostyrene or polyvinyltoluene; a styrene-based copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, or styrene-acrylonitrile-indene copolymer; or a mixture thereof. The acrylic acid may be, for example, but is not limited to, polyacrylic acid, polymethacrylic acid, polymethyl methacrylate, polymethyl α-chloromethacrylate, or a mixture thereof. The vinyl resin may be, for example, but is not limited to, polyvinyl chloride, polyethylene, propylene, polyacrylonitrie, polyvinyl acetate, or a mixture thereof. A number average molecular weight of the binder resin for a shell may be, for example, but is not limited to, in a range of about 700 to about 1,000,000, or about 10,000 to about 200,000. The binder resin for a shell may be the same as or different from a binder resin for a core.

The toner may further include an external additive. The external additive may be, for example, but is not limited to, silica particles, titanium dioxide particles, or a combination thereof. The silica particles may be, for example, fumed silica, sol-gel silica, or a mixture thereof. A volume average particle size of the silica particles may be in a range of, for example, about 10 nm to about 80 nm, about 30 nm to about 80 nm, or about 60 nm to about 80 nm. The titanium dioxide particles may be, for example, anatase titanium dioxide particles having an anatase crystal structure, rutile titanium dioxide particles having a rutile crystal structure, or a combination thereof. The silica particles and the titanium dioxide particles may be subjected to hydrophobic treatment by, for example, silicone oils, silanes, siloxanes, or silazanes. The amount of the external additive may be, for example, but is not limited to, in a range of about 1.5 parts by weight to about 4 parts by weight with respect to 100 parts by weight of toner parent particles (i.e., toner particles to which an external additive is not attached).

The toner may have a glass transition temperature of, for example, greater than about 55° C.

When the toner has a too large molecular weight or a too narrow molecular weight distribution, toner particles may have strong mechanical and physical properties, but cohesion between the toner particles may be deteriorated, resulting in reduced toner fixability. When the toner has a too small molecular weight and a very wide molecular weight distribution, the toner may have deteriorated mechanical and physical properties, and a toner image fixed on paper may be contaminated. The toner may have a weight average molecular weight of, for example, about 45,000 to about 55,000. The toner may have a molecular weight distribution of, for example, about 4.5 to about 5.5.

When the toner has a too low compressive modulus, toner particles have reduced hardness, and thus toner particles in an electrophotographic image forming unit may be deformed or broken by frictional stress. When the toner has a too high compressive modulus, mechanical and physical properties of toner particles may be deteriorated, particularly at a high temperature, and thus the toner may have deteriorated fixability. The toner may have a compressive modulus of, for example, about 750 MPa or more at room temperature (25° C.). In another example, the toner may have a compressive modulus at room temperature of, for example, about 750 MPa to about 2,500 MPa.

When the toner has a too low complex viscosity at a temperature that is 10° C. lower than the fixing temperature of the toner, cohesion of the binder resin in the toner may be excessively reduced, and thus an offset phenomenon of toner images may occur at a high temperature. When the toner has an excessively high complex viscosity at a temperature that is 10° C. lower than the fixing temperature of the toner, cohesion of the binder resin in the toner may be excessively increased, and thus a toner image fixed on paper may exhibit reduced gloss. In addition, it may be difficult to obtain an appropriate fixing strength of a toner image. The complex viscosity (η) of the toner at a temperature that is 10° C. lower than the fixing temperature of the toner may range from, for example, about 350 Pa·s to about 450 Pa·s. The complex velocity of the toner is measured by a temperature dispersion measurement method using a sinusoidal vibration method under conditions where a fixing unit has an angular velocity of 5 rad/s to 10 rad/s and a vibration frequency of 5 rad/s to 10 rad/s. The complex viscosity of the toner may be measured using, for example, an ARES measurement apparatus manufactured by Rheometric Scientific Corporation.

The fixing temperature of the toner may range from, for example, about 160° C. to about 200° C.

Stress relaxation refers to a decrease in stress over time when a constant strain is applied to toner. In other words, stress relaxation may refer to a change in the elastic modulus of toner over time when the toner stays in a fixing unit. When the stress relaxation of the toner is too small at a temperature that is 10° C. lower than the fixing temperature of the toner during a fixing heating time, liquid toner may exhibit deteriorated cohesion, and accordingly, a toner image may be contaminated. When the stress relaxation of the toner is too great at a temperature that is 10° C. lower than the fixing temperature of the toner during a fixing heating time, toner particles may have excessively strong elastic force. The stress relaxation of the toner at a temperature that is 10° C. lower than the fixing temperature of the toner during a fixing heating time may range from, for example, about $1\times10^4$ poise to about $3\times10^5$ poise.

In another example of the composite image forming apparatus according to the present disclosure, toner used in an electrophotographic image forming unit may have a viscosity of about $1\times10^3$ poise to about $1\times10^6$ poise at a melting temperature of the toner. In examples of the composite image forming apparatus according to the present disclosure, a rapid printing speed of a toner image by the electrophotographic image forming unit may compensate for a slow printing speed of an ink image by an inkjet image forming unit. In other words, the faster the printing speed of the toner image by the electrophotographic image forming unit, the shorter the overall printing time spent for toner image printing and ink image printing. When a toner image and an ink image are sequentially printed respectively on both sides of paper, paper having been rapidly taken out of the electrophotographic image forming unit may be at least partially accommodated in a relatively long second feed path before being supplied to the inkjet image forming unit. In addition, the lower the fixing temperature of the toner image in the electrophotographic image forming unit, the more the adverse effects on the drying of the ink image in the inkjet image forming unit may be prevented. However, as the printing speed of the toner image by the electrophotographic image forming unit becomes faster and the fixing temperature of the toner image by the electrophotographic image forming unit becomes lower, it is extremely difficult for the toner image to achieve all of excellent fixability, excellent optical density, excellent gloss, excellent sharpness, and excellent anti-raggedness. However, as described in the present disclosure, when toner has a viscosity of about $1\times10^3$ poise to about $1\times10^6$ poise at the melting temperature of the toner, a toner image may simultaneously achieve excellent fixability, excellent optical density, excellent gloss, excellent sharpness, and excellent anti-raggedness under conditions of a much faster printing speed of the toner image and a much lower fixing temperature of the toner image. The viscosity of the toner at the melting temperature of the toner may be adjusted by, for example, selecting the molecular weight of the binder resin in the toner. The larger the molecular weight of the binder resin in the toner, the higher the viscosity of the toner. The smaller the molecular weight of the binder resin in the toner, the lower the viscosity of the toner. In a case in which the binder resin in the toner is a mixture of binder resins having different molecular weights, as the binder resin having a larger molecular weight is included in the toner in a larger amount, the viscosity of the toner may be increased. In the case in which the binder resin in the toner is a mixture of binder resins having different molecular weights, as binder resins having a smaller molecular weight are included in the toner in a larger amount, the viscosity of the toner may be reduced.

In another example of the composite image forming apparatus according to the present disclosure, ink used in an inkjet image forming unit may include, for example, a colorant; and a carrier for dissolving or dispersing the colorant. The ink may further include a surfactant.

The colorant of the ink may include, for example, a dye, a pigment, or a combination thereof. When a pigment is used as the colorant, the ink may further include a dispersant that facilitates dispersion of the pigment. The pigment may also be a self-dispersible pigment that is effectively dispersible in the carrier without a separate dispersant. Non-limiting examples of the dye may include Food Black dyes, Food red dyes, Food Yellow dyes, Food Blue dyes, Acid Black dyes, Acid Red dyes, Acid Blue dyes, Acid Yellow dyes, Direct Black dyes, Direct Blue dyes, Direct Yellow dyes, anthraquinone dyes, monoazo dyes, disazo dyes, phthalocyanine derivatives, and combinations thereof. Non-limiting examples of the pigment may include carbon black, graphite, vitreous carbon, activated charcoal, activated carbon, an anthraquinone, phthalocyanine blue, phthalocyanine green, diazos, monoazos, pyranthrones, perylenes, quinacridones, indigoid pigments, and combinations thereof. Non-limiting examples of the self-dispersible pigment may include Cabojet-series pigments, CW-series pigments available from Orient Chemical, and combinations thereof. The amount of the colorant may be in a range of, for example, about 0.1 parts by weight to about 15 parts by weight with respect to 100 parts by weight of a total weight of the ink. For example, the amount of the colorant may be in a range of about 1 part by weight to about 10 parts by weight with respect to 100 parts by weight of the total weight of the ink. When the amount of the colorant is too small, it may be difficult to obtain ink with a desired color. When the amount of the colorant is too large, ink costs may be too expensive.

The carrier may be, for example, water. The carrier may also be, for example, a mixture of water and an organic solvent. By using the mixture of water and an organic solvent as the carrier and adding a surfactant, the viscosity and surface tension of the carrier may be easily adjusted to a desired range. The amount of the carrier may be in a range of, for example, about 70 parts by weight to about 90 parts by weight with respect to 100 parts by weight of the total weight of the ink. When the amount of the carrier is too small, the viscosity of the ink may be excessively high, and accordingly, ejection performance of the ink may be deteriorated. When the amount of the carrier is too large, the viscosity of the ink may be excessively low. Non-limiting examples of the organic solvent may include a monovalent alcohol-based solvent, a ketone-based solvent, an ester-based solvent, a polyhydric alcohol-based solvent or a derivative thereof, a nitrogen-containing solvent, dimethyl sulfoxide, tetramethylsulfone, a sulfur-containing compound of thioglycol, and a combination thereof. The monovalent alcohol-based solvent may enhance permeability of ink into paper, the ability of ink to form dots, and drying properties of an ink image by adjusting the surface tension of ink. The polyhydric alcohol-based solvent or a derivative thereof may not easily evaporate. In addition, the polyhydric alcohol-based solvent or a derivative thereof may reduce the freezing point of ink. Thus, the polyhydric alcohol-based solvent or a derivative thereof may enhance the storage stability of ink and accordingly, clogging of nozzles by ink may be prevented. Non-limiting examples of monovalent alcohols may include methyl alcohol, ethyl alcohol, n-propyl alcohol, i-propyl alcohol, n-butyl alcohol, s-butyl alcohol, t-butyl alcohol, and a combination thereof. Non-limiting examples of polyhydric alcohols may include alkylene glycols such as ethylene glycol, diethylene glycol, triethylene glycol, propylene glycol, butylene glycol, and glycerol; polyalkylene glycols such as polyethylene glycol and polypropylene glycol; thiodiglycol; and a combination thereof. Non-limiting examples of polyhydric alcohol derivatives may include alkylethers of polyhydric alcohols (e.g., ethylene glycol dimethyl ether), carboxylic acid esters of polyhydric alcohols (e.g., ethylene glycol diacetate), and a combination thereof. The ketone-based solvent may be, for example, but is not limited to, acetone, methyl ethyl ketone, diethyl ketone, diacetone alcohol, or a combination thereof. The ester-based solvent may be, for example, but is not limited to, methyl acetate, ethyl acetate, ethyl lactate, or a combination thereof. The nitrogen-containing solvent may be, for example, but is not limited to, 2-pyrrolidone, N-methyl-2-pyrrolidone, or a combination thereof. The sulfur-containing solvent may be, for example, but is not limited to, dimethyl sulfoxide, tetramethylene sulfone, thioglycol, or a combination thereof. When the carrier is a mixture of water and an organic solvent, the amount of the organic solvent in the mixture may range from about 0.1 parts by weight to about 130 parts by weight with respect to 100 parts by weight of water.

The surfactant may include, for example, an anionic surfactant, a non-ionic surfactant, or a combination thereof. The amount of the surfactant may be in a range of, for example, about 0.001 parts by weight to about 5.0 parts by weight with respect to 100 parts by weight of a total weight of ink.

The ink may further include an additive selected from, for example, a viscosity controller, a wetting agent, a metal oxide, a dispersant, a pH adjusting agent, an antioxidant, and a combination thereof, but the present disclosure is not limited thereto. The amount of the additive may be in a range of, for example, about 0.1 parts by weight to about 20 parts by weight with respect to 100 parts by weight of the total weight of ink.

The ink may further include an acid or a base. The acid or the base may increase the solubility of a wetting agent with respect to the carrier and stabilize the colorant. The amount of the acid or the base may be in a range of, for example, about 0.1 parts by weight to about 20 parts by weight with respect to 100 parts by weight of the total weight of ink.

The inkjet image forming unit may include a single type of ink. The inkjet image forming unit may also include at least two types of ink having different compositions. In another example, black ink, yellow ink, magenta ink, and cyan ink may be included in the inkjet image forming unit.

In another example of the composite image forming apparatus according to the present disclosure, ink used in an inkjet image forming unit may have a low range of surface tension. In examples of the composite image forming apparatus in which a toner image and an ink image are respectively printed on both surfaces of paper, a toner image is fixed on paper having been taken out of an electrophotographic image forming unit, Toner includes a lipophilic material such as a releasing agent. In a toner fixing process, the lipophilic material such as a releasing agent may permeate into paper. In addition, since paper is heated in the toner fixing process, paper having been taken out of the electrophotographic image forming unit may have a low moisture content. Accordingly, the process of fixing a toner image on paper may render the paper lipophilic. In other words, paper on which a toner image is fixed has a lower interfacial energy than that of paper on which a toner image is not fixed. In a case in which ink having a high surface tension is jetted onto such paper having a low interfacial energy, it is very difficult to obtain an ink image with excellent quality. Thus, by using ink having a low surface tension in the inkjet image forming unit, an ink image with excellent quality may be printed on the back surface of paper on which a toner image is fixed. The ink may have a surface tension of, for example, about 60 dyne/cm or less at 21° C. For example, the surface tension of the ink may be in a range of about 20 dyne/cm to about 55 dyne/cm at 21° C. For example, the surface tension of the ink may be in a range of about 20 dyne/cm to less than about 30 dyne/cm at 21° C. For example, the surface tension of the ink may be in a range of about 20 dyne/cm to about 25 dyne/cm at 21° C.

The ink may have a viscosity of, for example, about 1.5 cps to about 20 cps at 21° C. For example, the viscosity of the ink may be in a range of about 1.5 cps to about 3.5 cps at 21° C.

In another example of the composite image forming apparatus according to the present disclosure, ink used in the inkjet image forming unit may have a dynamic surface tension difference (i.e., $DST_{1\ sec}$-$DST_{20\ min}$) of about 15 dyne/cm to about 40 dyne/cm at 21° C. In examples of the composite image forming apparatus in which a toner image and an ink image are respectively printed on both surfaces of paper, the toner image is fixed on paper having been taken out of the electrophotographic image forming unit. Toner includes a lipophilic material such as a releasing agent. In the toner fixing process, the releasing agent may permeate into the paper. Accordingly, the process of fixing the toner image on the paper may render the paper lipophilic. According to the forgoing description, in the case in which the ink has a dynamic surface tension difference (i.e., $DST_{1\ sec}$–$DST_{20\ min}$) of about 15 dyne/cm to about 40 dyne/cm at 21° C., when an ink image is printed on the back surface of paper (i.e., paper with lipophilicity), a surface of which has a toner image fixed thereon, the printed ink image may simultaneously achieve excellent optical density, excellent gloss, excellent sharpness, and excellent anti-raggedness.

A composite image forming apparatus according to an example of the present disclosure includes: an electrophotographic image forming unit configured to print an image by supplying toner to a surface of paper, and including a transfer unit configured to form a transfer nip with a photoconductor and transfer a toner image from the photoconductor onto the paper, and a fixing unit configured to form a fixing nip through which the paper passes and fix the transferred toner image onto the paper; and an inkjet image forming unit including a feed roller configured to transport paper having passed through the electrophotographic image forming unit and configured to print an image on the back surface of the paper, wherein the inkjet image forming unit further includes ink, and the ink may have a low surface tension, for example, a surface tension of about 60 dyne/cm or less at 21° C., a surface tension of about 20 dyne/cm to about 55 dyne/cm at 21° C., a surface tension of about 20 dyne/cm to less than about 30 dyne/cm at 21° C., or a surface tension of about 20 dyne/cm to about 25 dyne/cm at 21° C. The electrophotographic image forming unit may further include toner, and the toner may have a viscosity of about $1\times10^3$ poise to about $1\times10^6$ poise at a melting point of the toner. The ink may have a dynamic surface tension difference (i.e., $DST_{1\ sec}$–$DST_{20\ min}$) of about 15 dyne/cm to about 40 dyne/cm.

A composite image forming method according to an example of the present disclosure includes: forming a toner image on a surface of paper in an electrophotographic image forming unit configured to print an image by supplying toner to a surface of paper, and including a transfer unit configured to form a transfer nip with a photoconductor and transfer a toner image from the photoconductor onto the paper, and a fixing unit configured to form a fixing nip through which the paper passes and fix the transferred toner image onto the paper; and forming an ink image on the back surface of the paper in an inkjet image forming unit including a feed roller configured to transport paper having passed through the electrophotographic image forming unit and configured to print an image on the back surface of the paper, wherein the inkjet image forming unit further includes ink, and the ink may include a low surface tension, for example, a surface tension of about 60 dyne/cm or less at 21° C., a surface tension of about 20 dyne/cm to about 55 dyne/cm at 21° C., a surface tension of about 20 dyne/cm to less than about 30 dyne/cm at 21° C., or a surface tension of about 20 dyne/cm to about 25 dyne/cm at 21° C. The electrophotographic image forming unit may further include toner, and the toner may have a viscosity of about $1\times10^3$ poise to about $1\times10^6$ poise at a melting temperature of the toner. The ink may have a dynamic surface tension difference (i.e., $DST_{1\ sec}$-$DST_{20\ min}$) of about 15 dyne/cm to about 40 dyne/cm at 21° C.

Due to the image forming apparatus and image forming method discussed above, a miniaturized composite image forming apparatus employing an electrophotographic image forming unit and an inkjet image forming unit may be implemented, and a composite image forming apparatus capable of stably transferring paper may be implemented.

EXAMPLES

Example 1—Preparation of Toner

Materials listed in Table 1 below were mixed at the proportions shown in Table 1 using a Henschel mixer. The mixture was melted and kneaded using an extruder. The resulting kneadate (kneaded mixture) was cooled while continuously passing through nozzles of the extruder. The cooled kneadate having been taken out of the nozzles was coarsely milled using a hammer mill, finely milled using a Jet mill, and then selected in size using a classifier. As a result, toner parent particles having a volume average particle size of 5.8 μm were obtained.

TABLE 1

| Material | Manufacturer | Specification | Amount |
|---|---|---|---|
| Carbon black | Cabot Co., USA | Mogul-L | 5 parts by weight |
| High-molecular-weight polyester resin H | KAO Co., Japan | Non-crystalline, Mw: 300,000 | 54 parts by weight |
| Low-molecular-weight polyester resin L | KAO Co., Japan | Non-crystalline, Mw: 50,000 | 34 parts by weight |
| Carnauba wax | Nippon Seiro Co. Ltd, Japan | Tm: 110° C. | 1 part by weight |
| Fatty acid ester wax | Sasol Co., South Africa | Tm: 76° C. | 2 parts by weight |
| Charge control agent | Hodogaya Co., Japan | T77 (Organo iron metal complex) | 2 parts by weight |

Next, the toner parent particles and an external additive having the composition of Table 2 below were stirred using an external adder (available from DAE WHA Tech Co., Ltd, "KMLS2K") at 2,000 rpm for 30 seconds and at 6,000 rpm for 3 minutes, thereby externally adding the external additive to surfaces of the toner parent particles. As a result, toner of Example 1 was obtained.

TABLE 2

| Material | Volume average particle size (nm) | Specific gravity (@25° C.) | Surface area ($m^2/g$) | Manufacturer (Product name) | Amount |
|---|---|---|---|---|---|
| Hydrophobic silica particles | 100 | 2.3 | 30 | Suckyoung, Korea, (SG100N) | 1 part by weight |
| Titanium oxide particles | 80 | 3.7 | 30 | Suckyoung, Korea, (SGT030) | 1 part by weight |

The toner of Example 1 had a melting temperature ($T_{1/2}$) of 133° C. The toner of Example 1 had a viscosity of 30,000 poise at the melting temperature ($T_{1/2}$) of the toner.

The melting temperature ($T_{1/2}$) of the toner is measured using a constant load extrusion type capillary rheometer. The constant load extrusion type capillary rheometer is a device for readily measuring performance such as thermal properties, viscosity properties, and the like of resins and the like, and measures viscosity resistance when a melt passes through a capillary tube. The melting temperature ($T_{1/2}$) based on the ½ method refers to a temperature at the half point of a piston stroke of the flowmeter between an outflow initiation temperature ($T_{1/2}$) and an outflow end temperature (Tend) of the outflow curve. Shimazu Flowtester CFD-500D available from Shimazu was used as the extrusion type capillary rheometer. A weight used weighed 1.5 kg, a die hole had a diameter of 1.0 mm, a heating rate was 6° C./min, an initiation temperature was 90° C., and a termination temperature was 200° C.

Examples 2 and 3—Preparation of Toners

Toners of Examples 2 and 3 were prepared in the same manner as in Example 1, except that amounts of high-molecular-weight polyester resin H and low-molecular-weight polyester resin L were varied. The amounts of the high-molecular-weight polyester resin H and the low-molecular-weight polyester resin L used in preparation of the toners of Examples 2 and 3; the melting temperature $T_{1/2}$ of the toners of Examples 2 and 3; and the viscosity of the toners of Examples 2 and 3 at the melting temperature ($T_{1/2}$) are shown in Table 3.

Comparative Examples 1 and 2—Preparation of Toners

Toners of Comparative Examples 1 and 2 were prepared in the same manner as in Example 1, except that amounts of high-molecular-weight polyester resin H and low-molecular-weight polyester resin L were varied. The amounts of the high-molecular-weight polyester resin H and the low-molecular-weight polyester resin L used in preparation of the toners of Comparative Examples 1 and 2; the melting temperature $T_{1/2}$ of the toners of Comparative Examples 1 and 2; and the viscosity of the toners of Comparative Examples 1 and 2 at the melting temperature ($T_{1/2}$) are shown in Table 3.

Comparative Example 3—Preparation of Toner

Toner of Comparative Example 3 was prepared in the same manner as in Example 1, except that the high-molecular-weight polyester resin H had an Mw of 600,000. The melting temperature $T_{1/2}$ of the toner of Comparative Example 3; and the viscosity of the toner of Comparative Example 3 at the melting temperature ($T_{1/2}$) are shown in Table 3.

Comparative Example 4—Preparation of Toner

Toner of Comparative Example 4 was prepared in the same manner as in Example 1, except that the high-molecular-weight polyester resin H had an Mw of 90,000. The melting temperature $T_{1/2}$ of the toner of Comparative Example 4; and the viscosity of the toner of Comparative Example 4 at the melting temperature ($T_{1/2}$) are shown in Table 3.

Comparative Example 5—Preparation of Toner

Toner of Comparative Example 5 was prepared in the same manner as in Example 1, except that the low-molecular-weight polyester resin L had an Mw of 150,000. The melting temperature $T_{1/2}$ of the toner of Comparative Example 5; and the viscosity of the toner of Comparative Example 5 at the melting temperature ($T_{1/2}$) are shown in Table 3.

Comparative Example 6—Preparation of Toner

Toner of Comparative Example 6 was prepared in the same manner as in Example 1, except that the low-molecular-weight polyester resin L had an Mw of 5,000. The melting temperature $T_{1/2}$ of the toner of Comparative Example 6; and the viscosity of the toner of Comparative Example 6 at the melting temperature ($T_{1/2}$) are shown in Table 3.

<Toner Performance Evaluation>

Fixability Evaluation

Equipment: Roller type fixing unit (manufacturer: Samsung Electronics Co., Ltd, Product Name: Fixing unit installed in Mono SL-M2028 model Laser Printer)

Un-fixed image for test: 100% pattern

Test temperature: 100° C. to 180° C. (an interval of 10° C.)

Fixing rate: 100 mm/sec

Fixing time: 0.08 sec

As described above, a fast printing speed of the toner image of the electrophotographic image forming unit may compensate for a slow printing speed of the ink image of the inkjet image forming unit. Thus, in the toner fixability evaluation, a fixing rate of 100 mm/sec and a fixing time of 0.08 sec were used to evaluate the fixability of a toner image at a fast printing speed.

Under the above-described conditions, a toner image was fixed on paper, and then the fixability of the fixed image was evaluated as follows. Optical density of the fixed image was measured. Then, 3M 810 tape was adhered to the fixed image, and then the tape was removed after reciprocating five times using a 500 g weight. The optical density of the fixed image was measured again after removing the tape.

Fixability (%)=(Optical density after tape peeling/optical density before tape peeling)×100

Fixability Evaluation Criteria

◎: fixability of toner of 90% or more (excellent fixability of toner)

○: fixability of toner of 85% to less than 90% (good fixability of toner)

Δ: fixability of toner of 80% to less than 85% (poor fixability of toner)

x: fixability of toner of less than 80% (very poor fixability of toner)

Optical Density (OD)

Each of the toners obtained in the examples and the comparative examples was placed in a toner cartridge of a one-component developing type printer (manufactured by Samsung Electronics Co., Ltd, Model Name: SL-M2028) in an environment room at room temperature (20±2° C.) and relative humidity (55±5%), and printing was performed under a condition of 1% coverage. After printing 10 sheets of paper, optical densities at three locations of an image region on the paper used when the 10th printing was performed were measured and an average thereof was calculated. The optical density was measured using an Electroeye reflective densitometer. The measurement results thereof were evaluated according to the fallowing criteria.

◎: OD of 1.4 or more (excellent OD)

○: OD of 1.2 to less than 1.4 (good OD)

Δ: OD of 1.0 to less than 1.2 (poor OD)

x: OD of less than 1.0 (very poor OD)

Gloss Evaluation

The degree of gloss (%) was measured at a temperature of the fixing unit of 160° C. using a gloss measuring instrument, a glossmeter (manufacturer: BYK Gardner, Product Name: micro-TRI-gloss) under the following conditions: measurement angle: 60°; and measurement pattern: 100% solid pattern.

◎: printing gloss of 40 or more (excellent printing gloss)

○: printing gloss of 35 to less than 40 (good printing gloss)

Δ: printing gloss of 30 to less than 35 (poor printing gloss)

x: printing gloss of less than 30 (very poor printing gloss)

Abrasion Resistance

An image with 1% coverage was printed on 1,000 sheets of paper using a one-component developing type printer (Samsung Electronics Co., Ltd, SL-M2028). The optical densities of the printed image on the $1^{st}$ sheet of paper and the printed image on the $1{,}000^{th}$ sheet of paper were measured. The abrasion resistance of toner was classified according to the following criteria.

◎: variance of optical density on the $1{,}000^{th}$ sheet of paper with respect to initial optical density is less than 10% (excellent durability of toner)

○: variance of optical density on the $1{,}000^{th}$ sheet of paper with respect to initial optical density is 10% to less than 20% (good durability of toner)

Δ: variance of optical density on the $1{,}000^{th}$ sheet of paper with respect to initial optical density is 20% to less than 30% (poor durability of toner)

x: variance of optical density on the $1{,}000^{th}$ sheet of paper with respect to initial optical density is 30% or greater (very poor durability of toner)

Developability

An image with 1% coverage was printed on 5,000 sheets of paper using a one-component developing-type printer (Samsung Electronics Co., Ltd, SL-M2028), and then developability evaluation was performed as follows. Before toner was transferred from a photoconductor to an intermediate transfer body, a toner image with a certain area was developed on the photoconductor, and then the toner image was collected using a filter-attached suction device and weighed to measure the toner weight per unit area of the photoconductor. In addition, the toner weight per unit area of the magnetic roller (Magroll) was simultaneously measured. Developability was evaluated using the following method.

Developing efficiency (%)=(toner weight per unit area of the photoconductor/toner weight per unit area of the magnetic roller)×100

◎: developing efficiency of 90% or more (excellent developability of toner)

○: developing efficiency of 80% to less than 90% (good developability of toner)

Δ: developing efficiency of 70% to less than 80% (poor developability of toner)

x: developing efficiency of less than 70% (very poor developability of toner)

Performance evaluation results of the toners of the examples and the comparative examples are shown in Table 3 below.

TABLE 3

| Examples | Mw of H<br>Mw of L | Pbw# of H<br>Pbw of L | $T_{1/2}$<br>(° C.) | Viscosity<br>(poise) | Fixability | OD | Gloss | Abrasion resistance | Developability |
|---|---|---|---|---|---|---|---|---|---|
| Example 1 | 300,000<br>50,000 | 54<br>34 | 133 | $3 \times 10^4$ | ◎ | ◎ | ◎ | ◎ | ◎ |
| Example 2 | 300,000<br>50,000 | 50<br>38 | 133 | $1 \times 10^3$ | ◎ | ◎ | ◎ | ◎ | ◎ |
| Example 3 | 300,000<br>50,000 | 60<br>28 | 133 | $1 \times 10^6$ | ◎ | ◎ | ◎ | ◎ | ◎ |
| CE* 1 | 300,000<br>50,000 | 44<br>44 | 133 | $9 \times 10^2$ | Δ | ○ | ◎ | ○ | ○ |
| CE 2 | 300,000<br>50,000 | 61.6<br>26.4 | 133 | $2 \times 10^6$ | ○ | ○ | ○ | Δ | ○ |
| CE 3 | 600,000<br>50,000 | 54<br>34 | 133 | $2 \times 10^6$ | ○ | ○ | ○ | Δ | ○ |
| CE 4 | 90,000<br>50,000 | 54<br>34 | 133 | $5 \times 10^2$ | X | ○ | ◎ | Δ | Δ |
| CE 5 | 300,000<br>150,000 | 54<br>34 | 133 | $2 \times 10^6$ | Δ | ○ | Δ | Δ | Δ |
| CE 6 | 300,000<br>5,000 | 54<br>34 | 133 | $5 \times 10^2$ | X | ○ | ◎ | X | Δ |

*CE: Comparative Example,
#Pbw: parts by weight

Example 4—Preparation of Ink Composition

Materials listed in Table 4 below were mixed with the composition shown in Table 4 to prepare an ink composition for inkjet recording of Example 4.

TABLE 4

| Materials | Manufacturer | Amount |
|---|---|---|
| C.I. Basic Black 2 | Clariant | 4.5 parts by weight |
| Surfynol 485 (surfactant) | Airproduct Corporation (USA) | 0.5 parts by weight |
| Etriol (trimethylol propane) | SigmaAldrich Corporation | 5 parts by weight |
| Diethylene glycol | SigmaAldrich Corporation | 9.5 parts by weight |
| Ethylene glycol | SigmaAldrich Corporation | 10.5 parts by weight |
| Diethanol amine | SigmaAldrich Corporation | 6 parts by weight |
| Deionized water | — | 64 parts by weight |

Examples 5 and 6—Preparation of Ink Compositions

Ink compositions of Examples 5 and 6 were prepared in the same manner as in Example 4, except that the amount of Surfynol 485 surfactant and the amount of deionized water were changed. The amount of Surfynol 485 surfactant used in the preparation of the ink compositions of Examples 5 and 6 is shown in Table 5 below.

Comparative Examples 7 and 8—Preparation of Ink Compositions

Ink compositions of Comparative Examples 7 and 8 were prepared in the same manner as in Example 4, except that the amount of Surfynol 485 surfactant and the amount of deionized water were changed (in this case, the sum of parts by weight of the surfactant and parts by weight of the deionized water was maintained at the same level). The amount of Surfynol 485 surfactant used in the preparation of the ink compositions of Comparative Examples 7 and 8 is shown in Table 5 below.

<Evaluation of Ink Compositions>

Surface Tension Measurement

Static surface tensions of the ink compositions of the examples and the comparative examples were measured at 21° C. using DSA 100 instrument manufactured by KRUSS GmbH.

Dynamic Surface Tension Measurement

Dynamic surface tensions of the ink compositions of the examples and the comparative examples were measured at 21° C. and at 1 second and after 20 minutes using Bubble Pressure Tensiometer BP2 instrument manufactured by KRÜSS GmbH.

Optical Density (OD)

Each of the ink compositions obtained in the examples and the comparative examples was placed in an ink cartridge of an inkjet printer (manufactured by Samsung Electronics Co., Ltd, Model Name: SL-J1760) in an environment room at room temperature (20±2° C.) and relative humidity (55±5%), and printing was performed with 1% coverage. In this case, printing paper used in inkjet printing was printed paper obtained by setting the toner of Example 1 in a toner cartridge of a one-component developing-type printer (manufactured by Samsung Electronics Co., Ltd, Model: SL-M2028) in an environment room at room temperature (20±2° C.) and relative humidity (55±5%), and performing printing with 1% coverage. An inkjet image was printed on the printed surface on which the toner image was formed. After printing an inkjet image on 10 sheets of paper, optical densities (OD) at three locations of an image region on the 10th sheet of printed paper were measured and an average thereof was calculated. The optical density was measured using an Electroeye reflective densitometer. The measurement results thereof were evaluated according to the following criteria.

◎: OD of image of 1.4 or more (excellent OD of image)
○: OD of image of 1.2 to less than 1.4 (good OD of image)
Δ: OD of image of 1.0 to less than 1.2 (poor OD of image)
x: OD of image of less than 1.0 (very poor OD of image)

Gloss Evaluation

The degree of gloss (%) was measured using a gloss measuring instrument, a glossmeter (manufacturer: BYK Gardner, Product Name: micro-TRI-gloss) under the following conditions: measurement angle: 60°; and measurement pattern: 100% solid pattern (each of the ink compositions obtained in the examples and the comparative examples was placed in an ink cartridge of an inkjet printer (manufactured by Samsung Electronics Co., Ltd, Model Name: SL-J1760) in an environment room at room temperature (20±2° C.) and relative humidity (55±5%), and then printing was performed; new sheets of printing paper were used).

◎: printing gloss of 40 or more (excellent printing gloss)

○: printing gloss of 35 to less than 40 (good printing gloss)

Δ: printing gloss of 30 to less than 35 (poor printing gloss)

x: printing gloss of less than 30 (very poor printing gloss)

Smear-Fastness

Ink cartridge M-50 (manufactured by Samsung Electronics Co., Ltd) was refilled with each of the ink compositions of the examples and the comparative examples, and then test patterns were printed with C-60 color ink (manufactured by Samsung Electronics Co., Ltd) using a printer (SL-J1760, manufactured by Samsung Electronics Co., Ltd). After 30 minutes, the position of a dotted line where color mixing occurs, when based on a boundary between neighboring two colors, was measured using a microscope (evaluation criteria: refer to U.S. Pat. No. 5,854,307).

※ The degree of smear-fastness is evaluated based on the following criteria

○: no color mixing occurred throughout the boundary

Δ: color mixing occurred in a width corresponding to a diameter from 1 dot to 3 dots x: color mixing occurred in a width corresponding to a diameter of 4 dots or more (wherein, on the basis of 600 dpi, 1 dot diameter=100 μm)

Performance evaluation results of the inkjet compositions of the examples and the comparative examples are shown in Table 5 below.

TABLE 5

| Examples | Amount of surfactant (Pbw#) | Static surface tension (@21° C.) (dyne/cm) | Dynamic surface tension (@21° C., 1 sec) (dyne/cm) | Dynamic surface tension (@21° C., 20 min) (dyne/cm) | Difference in dynamic surface tension | OD | Gloss | Abrasion resistance |
|---|---|---|---|---|---|---|---|---|
| Example 4 | 0.5 | 30 | 33 | 63 | 30 | ○ | ○ | ○ |
| Example 5 | 0.3 | 35 | 45 | 60 | 15 | ○ | ○ | ○ |
| Example 6 | 1.0 | 25 | 30 | 70 | 40 | ○ | ○ | ○ |
| CE* 7 | 1.5 | 20 | 20 | 70 | 50 | Δ | Δ | X |
| CE 8 | 0.1 | 50 | 55 | 60 | 5 | Δ | Δ | X |

*CE: Comparative Example,
#Pbw: parts by weight

It should be understood that the aforementioned examples and the illustrations of the drawings are not intended to limit the scope of the present disclosure, and many changes and modifications are possible within the scope of the following claims.

The invention claimed is:

1. An image forming apparatus comprising:

an inkjet image forming unit comprising a feed roller to transport a recording medium;

a first feed path connecting a fixing unit which fixes a toner image onto the recording medium and the feed roller;

a second feed path connecting the fixing unit and the feed roller, wherein the second feed path does not include an entirety of the first feed path; and a feed path switching member to be switchable to a first position to guide the recording medium having passed through the fixing unit to the first feed path, and to be switchable to a second position to guide the recording medium having passed through the fixing unit to the second feed path.

2. The image forming apparatus of claim 1, wherein the second feed path is to accommodate a curl of the recording medium.

3. The image forming apparatus of claim 2, wherein the second feed path is longer than the first feed path and is to accommodate at least 60% of a length of the recording medium.

4. The image forming apparatus of claim 1, wherein the inkjet image forming unit has a paper-feeding speed equal to or less than an electrophotographic image forming unit that prints an image on a front surface of the recording medium.

5. The image forming apparatus of claim 1, further comprising a controller to release a fixing nip formed by the fixing unit through which the recording medium passes when the inkjet image forming unit is operated and an electrophotographic image forming unit that prints an image on a front surface of the recording medium is not operated.

6. The image forming apparatus of claim 1, further comprising a controller to release a fixing nip formed by the fixing unit through which the recording medium passes, when duplex printing is performed and an end of the recording medium passes through the fixing nip.

7. The image forming apparatus of claim 1, further comprising a recording medium feeder to feed the recording medium, wherein the inkjet image forming unit is located above the recording medium feeder and an electrophotographic image forming unit that prints an image on a front surface of the recording medium such that a recording medium feed path connecting the recording medium feeder, the electrophotographic image forming unit, and the inkjet image forming unit is C-shaped.

8. The image forming apparatus of claim 1, wherein the image forming apparatus comprises:

a first body having an electrophotographic image forming unit that prints an image on a front surface of the recording medium arranged therein; and a second body having the inkjet image forming unit arranged therein, wherein the second body is rotatably installed to the first body.

9. The image forming apparatus of claim 8, wherein the second body is to open or close an upper portion of the first body.

10. The image forming apparatus of claim 9, wherein the electrophotographic image forming unit further comprises a developing device to develop the toner image on a photoconductor, wherein the second body opens the upper portion of the first body to form a space allowing the developing device to be detachable.

11. The image forming apparatus of claim 1, wherein the inkjet image forming unit is to print an image on a back surface of the recording medium.

12. The image forming apparatus of claim 1, wherein the inkjet image forming unit further comprises ink and the ink has a surface tension of 20 dyne/cm to 55 dyne/cm at 21° C.

13. The image forming apparatus of claim 1, wherein toner to be used for the toner image has a viscosity of $1\times10^3$ poise to $1\times10^6$ poise at a melting temperature of the toner.

14. The image forming apparatus of claim 12, wherein the ink has a dynamic surface tension difference ($DST_{1sec}$–$DST_{20min}$) of 15 dyne/cm to 40 dyne/cm at 21° C.

15. An image forming method comprising:

forming an ink image on a recording medium in an inkjet image forming unit comprising a feed roller to transport a recording medium; and switching a switching member to guide the recording medium having passed through a fixing unit which fixes a toner image onto the recording medium to a first feed path or to guide the recording medium having passed through the fixing unit to a second feed path, wherein the second feed path does not include an entirety of the first feed path, and the first feed path connects the fixing unit and the feed roller, and the second feed path connects the fixing unit and the feed roller.

* * * * *